US006957882B2

(12) United States Patent
Wouters et al.

(10) Patent No.: US 6,957,882 B2
(45) Date of Patent: Oct. 25, 2005

(54) INK TANK FOR FEEDING A SHUTTLING INKJET PRINTING HEAD

(75) Inventors: Paul Wouters, Bonheiden (BE); Bart Verhoest, Niel (BE)

(73) Assignee: Agfa Gevaert N. V., Mortsel (BE)

( * ) Notice: Subject to any disclaimer, the term of this patent is extended or adjusted under 35 U.S.C. 154(b) by 0 days.

(21) Appl. No.: 10/438,697

(22) Filed: May 15, 2003

(65) Prior Publication Data

US 2005/0073558 A1 Apr. 7, 2005

Related U.S. Application Data

(60) Provisional application No. 60/385,391, filed on Jun. 3, 2002.

(51) Int. Cl.[7] ..... B41J 2/175
(52) U.S. Cl. ..... 347/86
(58) Field of Search ..... 347/7, 85, 86, 347/87, 94

(56) References Cited

U.S. PATENT DOCUMENTS 5,444,473 A * 8/1995 Hattori et al. ..... 347/87
5,984,462 A * 11/1999 DeFilippis ..... 347/86
6,003,966 A * 12/1999 Ahn ..... 347/7
6,554,411 B1 * 4/2003 Hatasa et al. ..... 347/86
6,623,092 B2 * 9/2003 Kim et al. ..... 347/7

FOREIGN PATENT DOCUMENTS

| | | |
|---|---|---|
| EP | 0 812 693 A1 | 12/1997 |
| EP | 1 055 520 A1 | 11/2000 |
| EP | 1 097 814 A2 | 5/2001 |
| EP | 1 199 178 A1 | 4/2002 |
| EP | 02 10 0552 | 9/2002 |

* cited by examiner

*Primary Examiner*—Anh T. N. Vo
(74) *Attorney, Agent, or Firm*—John A. Merecki; Robert A. Sabourin

(57) ABSTRACT

An ink tank and a print head are mounted on a carriage for supplying ink to an inkjet print. The ink tank includes: one or more ink chambers, where each of the ink chambers includes one or more functional elements (1) symmetrically arranged, mounted and centered about a center plane of the respective ink chamber, and (2) positioned perpendicular to a direction of movement of the carriage. The functional elements include, for example, a feed outlet for feeding ink to the print head, a supply inlet for supplying ink to the ink chamber, an ink movement damper, an ink level sensor, a vacuum inlet to extract air from the ink chamber, and a re-flow inlet to allow re-flow of air bubbles from the print head to the ink chamber.

10 Claims, 3 Drawing Sheets

INK TANK FOR FEEDING A SHUTTLING INKJET PRINTING HEAD

This application claims the benefit of U.S. provisional patent application No. 60/385,391 filed on Jun. 3, 2002.

FIELD OF THE INVENTION

The present invention relates to an apparatus having improved recording quality in inkjet printing systems having a shuttling print head and more specifically an ink tank for such an apparatus having a stable pressure in the supply chamber to such a print head.

BACKGROUND OF THE INVENTION

Inkjet Printing

Nowadays a lot of printed matter is produced carrying a reproduction of a colour image. A large part of these colour prints are produced using offset printing but in office and home environment a lot of colour prints are made using relatively small printing apparatuses. One of the possible printers used is an inkjet printer. In an inkjet printer drops of ink are jetted out of a nozzle toward a receiving layer which may be e.g. specially coated paper.

Usually an inkjet print head has an array of nozzles, each nozzle jetting ink to different locations at the same time.

The ink is jetted out of the nozzles by use of e.g. thermal or piezoelectric actuators creating a pressure wave.

It is normally the intention that the size of the droplets can be kept constant or that there is a good control of the droplet size in printers capable of recording variable droplet sizes.

Print Head

In FIG. 1 an inkjet print head is depicted with capillary tubes 1 having a nozzle end and a inlet end. For each tube 1 an actuator 2 is provided for causing a pressure wave expelling the ink out of the nozzle at the end. At the other end ink is fed to the print head from an ink tank.

In normal rest condition the ink forming a meniscus 3 at the nozzle end in the capillary tubes 1 is influenced by surface tension forces. Another force acting upon the ink is the "hydrostatic" pressure caused by gravity due to the height of the ink above the meniscus 3. Because the inkjet print head is fully filled with ink and it is connected to the ink tank, the level of the ink in the ink tank determines the pressure of the ink in the print head. When placing the ink tank above the print head, a positive ink pressure will arise due to the vertical height difference between ink level and nozzles.

Some types of print heads need a stable negative ink pressure at the nozzle area for good printing.

To reach finally a negative pressure at the nozzles, this positive pressure can be neutralised by applying a negative pressure above the ink in the header tank.

A problem is that in order to obtain constant or controllable recording quality the negative pressure in the head and tank is to be kept constant or within a small range.

Shuttling Print Head with Header Tank

In recent time inkjet printing technology is also used in large format, high volume printers Inkjet print heads can be as large as the transversal size of an image or text to be printed but usually the size of the print head is smaller. Page wide print heads are still expensive and less reliable than smaller types.

FIG. 2 gives a view of how an inkjet printer composes a whole image. A receiving sheet 4, e.g. a sheet of paper is transported in one direction (transport direction indicated by arrow A) and passed gradually underneath the printing station.

The print head 5 which has a size smaller than the receiving sheet 4 shuttles transversal (indicated by arrow B) over it and consecutively records one or more lines when shutting over the sheet 4 paper. The image is composed gradually.

It is possible that several print heads are used to record different colours and a colour image is recorded by superposition of the different colour images.

In order to enable continuous operation of a print head 5, an ink tank containing an ink supply is coupled to the print head 5. Small printers usually have a small cartridge, optionally with integrated print head nozzles, containing only a limited amount of ink.

When empty these cartridges have to be replaced. High end inkjet printers having a high throughput or large formats however consume a large amount of ink.

The inkjet print head of a high end printer is coupled with an ink tank and mounted on the shuttling carriage carrying the print head. This ink tank is called a header tank and can be refilled out of a large capacity ink tank which is stationary.

Refilling of the Header Tank

Possible refill arrangements can be found in EP-A1 097 814, herein incorporated by reference in its entirety as background information. When the level of ink in the header tank is too low the shuttling carriage is transported to a refilling station outside the printing area where the header tank is refilled.

A considerable problem in this method is the difficulty to maintain a constant ink pressure in the print head. The height of the level of ink in the header tank diminishes constantly giving rise to less pressure due to gravity and causing variations in recording quality.

The level can be kept relatively constant by refilling very often but no recording can be done during refilling giving rise to lower throughput rates as the carriage has to be stopped each time.

In EP-A-1 142 713, herein incorporated by reference in its entirety as background information, a system for refilling a header tank is described wherein refilling can be done during printing. The header tank on the shuttling carriage is connected by flexible tubes to a feeder tank. The main tank is pressurised and when a replenishing valve is opened ink is pressed by the air pressure from the feeder tank to the header tank during printing operation. A supplementary valve is placed between the header tank and the print head.

It is an overall problem to keep the pressure in the print head at a constant level:

- the "hydrostatic" pressure has to be counteracted during printing, even during refilling the header tank with large amounts of ink.
- the "hydrostatic" pressure may vary due to acceleration forces during shuttling. It is clear that during acceleration the ink surface will not be horizontal and that accelerations produce pressure gradients within the header tank.
- A reliable method for measuring the ink level in the header tank is necessary to ensure accurate refilling of the header tank. Due to the movement of the ink within the header tank the measurement of a float may not be reliable.

It is desirable that a system is provided capable of exactly metering the amount of ink that is fed to the header tank.

Another problem is that during shuttling of the carriage carrying the header tank, the ink is whipped up and bubbles of trapped air are likely formed within the ink. As these bubbles can be transported to the print head with the flow of ink, they may give rise to defects in the printed image. No extra measures have been taken in the prior art in order to avoid or counteract the effect of the air bubbles.

When shuttling the ink tank simultaneously with the print head, mechanisms should be implemented for damping the pressure fluctuations in the ink connection to the print head, due to the movement of the carriage. Pressure variations can have negative influence on print quality.

A further problem is that to allow a compact staggering of print heads, the ink tank dimensions should be smaller than the print head itself.

SUMMARY OF THE INVENTION

The above-mentioned drawbacks are counteracted by an apparatus having the specific features set out in claim 1. Specific features for preferred embodiments of the invention are set out in the dependent claims.

Further advantages and embodiments of the present invention will become apparent from the following description and drawings.

DETAILED DESCRIPTION OF THE INVENTION

The present invention solves above mentioned drawbacks by providing a header tank having functional elements arranged symmetrical to the centre plane perpendicular to the direction of movement of the shuttling carriage of the printer.

Next a preferred embodiment of an ink tank according to the present invention is described.

Figure 1:
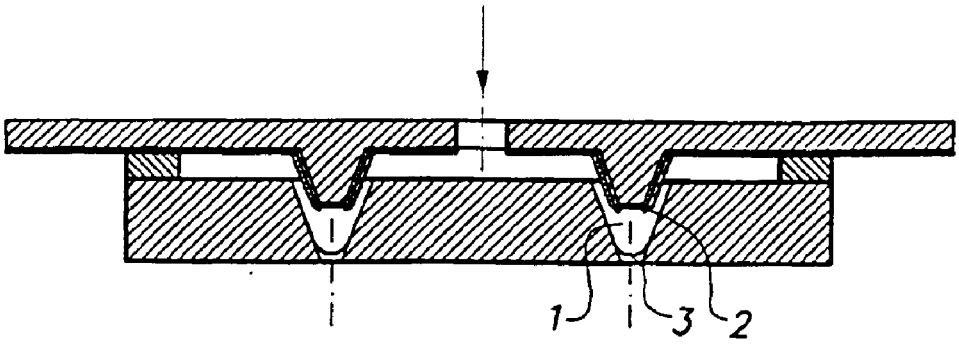
FIG. 1 (PRIOR ART)
FIG. 1 depicts a cross-section of an inkjet print head.
Figure 2:
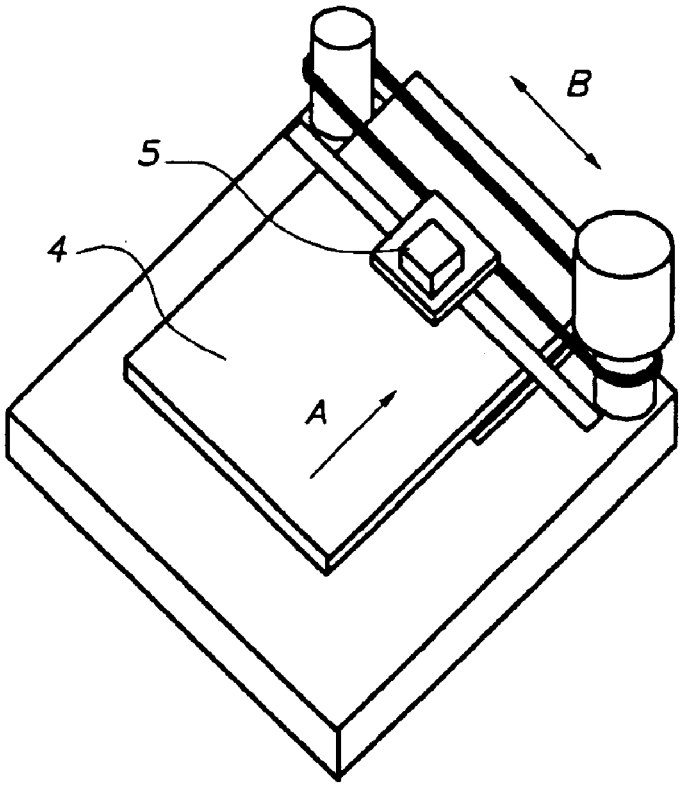
FIG. 2 (PRIOR ART)
FIG. 2 illustrates the overall printing principle of an inkjet printer with a shuttling print head.
Figure 3A:
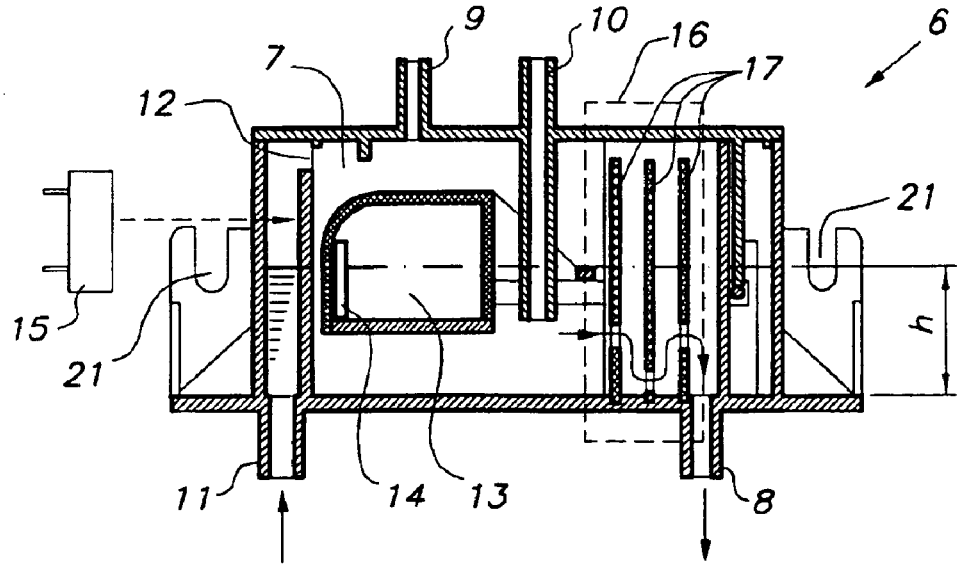
FIG. 3A shows a cross section of an ink tank according to the invention.

FIG. 3A depicts a cross section perpendicular to the shuttling direction of a header tank 6 according to the present invention.

Figure 3B:
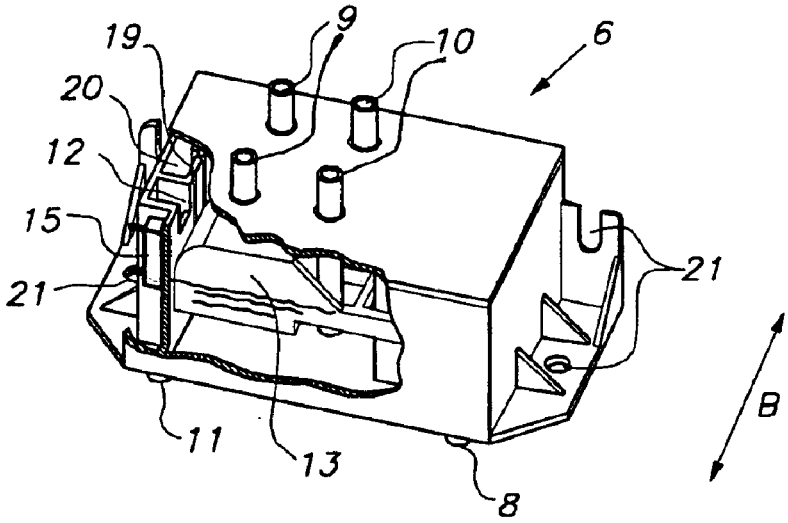
FIG. 3B gives an isometric view of a dual ink tank assembly

FIG. 3B shows a combination of 2 tanks having further features which will be described later on.

Figure 5:
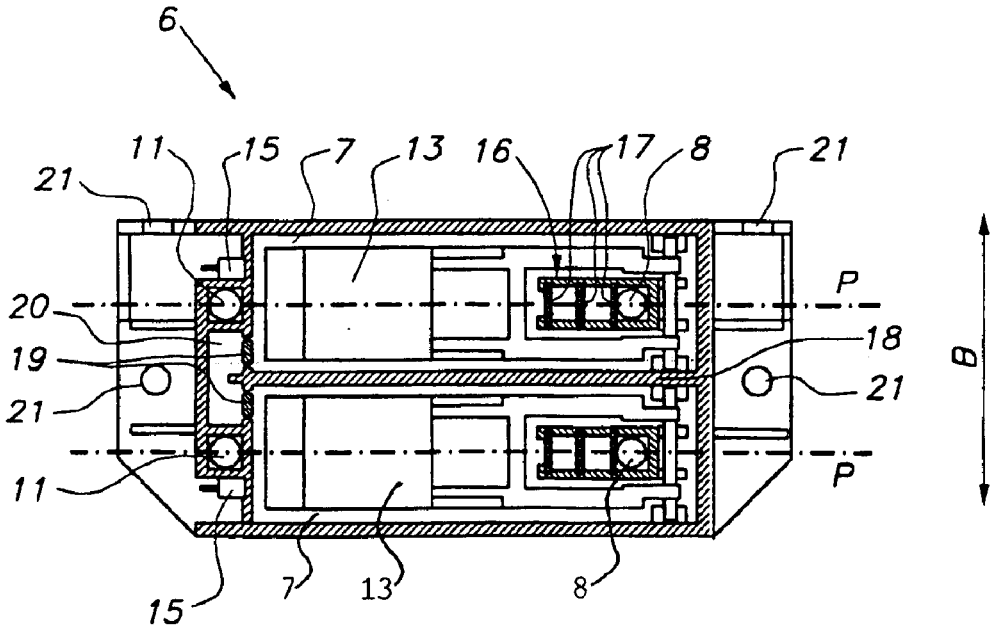
FIG. 5 shows an horizontal cross-section of a dual ink tank assembly.

FIG. 5 gives a horizontal section of the dual tank combination.

The double pointed arrow B indicates the shuttling direction of the print carriage containing the print head and the header tank. Plane P is the centre plane perpendicular to this direction.

The ink tank 6 has an ink chamber 7 and contains or is in connection with several functional elements.

As functional elements are considered all features which have an influence upon the working of the ink tank 6.

Several functional features can be seen in this view.

Ink is fed via ink feed outlet 8 from the bottom of the ink chamber 7 to the inkjet print head 5. The height difference between the ink level and print head is defining the gravimetric pressure in the print head and height differences should be minimised. Placement of outlet 8 should be kept constant to avoid pressure fluctuations. The pressure in the print head 5 is directly determined by the pressure at the feed outlet 8 of the header tank 6.

The supply inlet 10 of the header tank 6 enables replenishment of the ink in the ink chamber 7 using ink from the main tank to the header tank during replenishment. The inlet is formed by a tube reaching below the ink level in the header tank 6 in order to allow smooth refilling. Care has to be taken that during replenishment no pressure variations are generated due to the inflow of fresh ink.

At the vacuum inlet 9 on top of the ink chamber 7 a stable negative pressure is applied to the ink chamber 7 of the header tank 6 to compensate the positive "hydrostatic" pressure due to gravity. This is realised by air extraction on the top of the ink chamber 7, above the ink level. A system for providing the vacuum or negative pressure to the ink chamber 7 will be described later.

re-flow inlet 11 is connected to the print head 5 in order to allow re-flow of air bubbles originating from the print head 5 to the ink chamber 7. A small channel 12 provides connection with the ink chamber above the ink level.

Figures 4A, 4B, 4C:
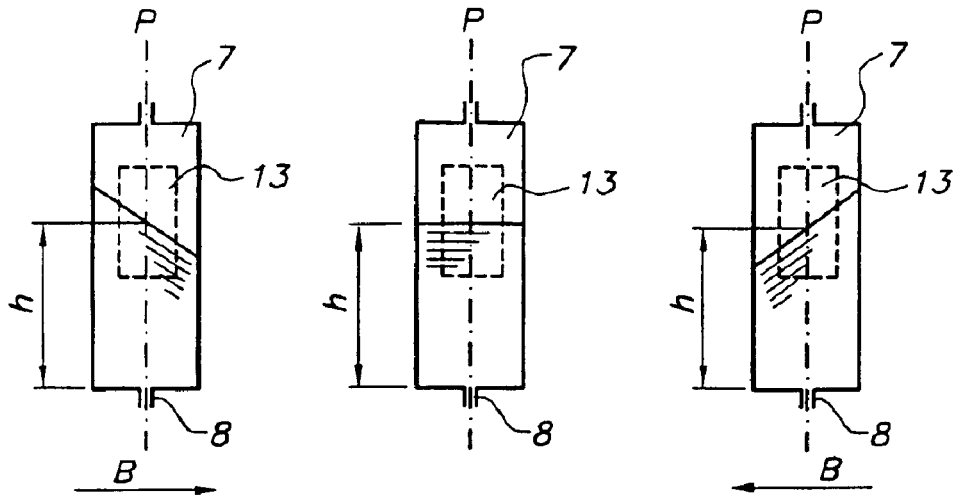
FIGS. 4A to 4C show the ink level in a tank during acceleration and during rest or continuous motion.

FIGS. 4A to 4C depict the ink level in an ink tank 6 during three stages.

acceleration to the left, acceleration to the right, without acceleration (e.g. shuttling stopped)

It the three cases the ink amount in the header tank 6 is identical.

As is illustrated the ink surface in the ink chamber during state L in FIG. 4A and R in FIG. 4C is inclined due to the acceleration of the ink tank and the inertia of the ink in the ink chamber. A gradient of the hydrostatic pressure is created within the body of the ink. Because the feed outlet 8 is situated in the centre plane perpendicular to the direction of movement of the carriage, the height of the ink level h at the position of the outlet 8 in the ink chamber 7 is not influenced as can be seen in FIG. 4A to FIG. 4C. The inclination of the ink level (due to ac- and deceleration of the carriage) is pivoting symmetrically and the level height h in the middle of each tank stays stable. By placing the ink outlet 8 to the print head along the centre plane pressure variations due to shuttling of the head can be minimised.

When considering the location of the inlet 10 for ink replenishment into the chamber 7 it is to be avoided that inflow of the ink causes pressure changes. The most neutral placement of the inlet 10 is also in the centre plane of the ink chamber 7. The inlet 10 constructed to ensure that ink is supplied under the ink level in order to avoid drops falling into the tank causing e.g. trapping of air in bubbles etc.

A further functional feature is the system regulating the ink level in the ink chamber. 7

A constant ink level is realised by an ink level sensor. Inside the ink chamber 7 a float 13 is provided having a integrated magnet 14 In combination with a reed contact 15 which is fixed at the outside of the ink chamber 7 a level detection system is provided.

The ink tank 6 is suited for inks with different specific gravity, by choosing a big volume of the float 13 it is dimensioned for low specific density (i.e. oil based) inks.

By choosing the dimensions of the float 13 big in relation to the dimensions of the ink tank 6, a certain dampening of ink movement is obtained.

The float 13 can be mounted in the ink chamber 7 using a hinge having low tolerance in order to ensure that the position remains central inside the ink chamber 7 during shuttling movement.

Preferable the float 13 itself is also symmetrical.

The ink level h can be kept constant, independent of the ink type, by adjusting the fixing height of the reed contact 15.

By constructing the float 13 symmetrical regarding to the centre plane perpendicular to the shuttling direction B the reading of the ink level sensor system it is not influenced by the position of the ink level surfaces as shown in FIGS. 4A AND 4C.

The reed contact 15 commands a pump for pumping ink from the main tank to the header tank 6 during replenishment of the header tank 6.

Further an ink movement damper 16 for dampening further pressure variations, due to the shuttling, is integrated in the ink tank 6.

This ink movement damper 16 is located between the ink chamber 7 and the ink outlet 8 to the print head 5. To restrict ink movement inside the damper 16, the dimensions are chosen smaller than the width of the ink chamber 7. Preferably the size in the shuttling direction B is less than half the size of the ink chamber 7.

The damper 16 can be executed in the form of a labyrinth, a mesh or a porous member restricting movement of the ink near the outlet opening 8 of the ink chamber 7. In FIG. 3 a labyrinth is shown in the right side of the ink chamber 7. Several partitions 17 having perforations at different heights are provided so the ink can not travel in a straight path to the outlet opening 8. In order to avoid pressure and flow variations due to the shuttling movement the damper 16 is constructed symmetrically regarding the centre plane of the ink tank 6.

This damper 16 has also a important degassing function of ink flowing from ink chamber 7 into the print head.

As ink is fed from the ink chamber 7 to the outlet 8. A flow of ink is induced through the damper 16. The ink is forced to take several turns through the labyrinth formed by partitions 17. Air bubbles trapped in the ink have the tendency to rise to the top, where they can join with the air above the ink level in the tank 6. The air outlet of the ink damper 16 preferably has to reach above the ink level.

Because of the application of a constant negative pressure an amount of trapped air tends to form a greater bubble than at atmospheric pressure and therefore can be more easily separated because large bubbles tend to rise more quickly.

The ink feed system for the print head 5 is realised by two ink connections between ink tank 6 and print head 5.

A first connection from the ink outlet 8 to the print head 5 is on the bottom of the ink tank 6, behind the damper 16. This opening is feeding ink into the print head 5.

A second connection coupled to the re-flow inlet 11 will allow air-bubbles to return from the print head 5 into the ink tank 6. This is especially important if a new (empty) print head 5 is to be filled with ink. The height of the connection of the opening with the tank 6 is located above the ink level in the ink tank 6.

Via this connection the negative pressure is also supplied to the inkjet print head 5 directly.

In order to provide a constant vacuum source the ink tank 6 is connected to a large volume vacuum container in which vacuum is sustained by a small capacity extraction pump under control of a precise pressure regulator. By choosing a large vacuum reserve, pressure will not vary easily even during a replenishment step in which a large amount of ink is added to the header tank 6. The pressure of a large vacuum holder will vary only with a small amount when a relatively small volume of ink is added to the system. The volume of the vacuum reservoir preferably is at least 5 times larger than the volume of the ink chamber 7. More preferably the volume of the vacuum reservoir is 50 to 100 times larger than the volume of the ink chamber 7.

The ink tank 6 can for the greater part be produced using known processes like injection moulding. To the inner sides of the ink chamber 7 a special coating can be applied in order to obtain oleophobic characteristics.

In order to lower production costs it is possible to produce assemblies of coupled ink tanks 6 having common side-walls. A combination of two ink tanks is shown in FIG. 5.

As for each colour a separate tank is to be provided the use of combinations of ink tanks 6 having a common side-wall 18 has a cost advantage.

Another possibility is that in the common side-walls 18 of the tanks 6 special break-away seals 19 is provided which can be removed so that out of the multiple tanks 6 a single tank can be made. E.g. for use in a high-end black and white printer. The connection of the ink tanks 6 can also be made in other ways, e.g. special ink channel 20 can be provided with breakable seals 19.

In order to prevent ink level variations during shuttling, the dimensions of the unsealed opening have to be small so only a small amount of ink can pass through the opening between the tanks 6 during shuttling.

The combination of several tanks 6 has a further advantage. As can be seen in FIGS. 3A, 3B and 5, the ink tanks 6 are equipped with several mounting holes/slits 21 in order to allow easy replacement of the ink tank 6 using screws or other fastening means in the printer. Preferably mounting means having quick release systems are used. This can be necessary when changing ink type or colour in the inkjet printing apparatus. When several tanks 6 are mounted together on the shuttling carriage, replacement can be done quicker than when each tank 6 is mounted separately.

Having described in detail preferred embodiments of the current invention, it will now be apparent to those skilled in the art that numerous modifications can be made therein without departing from the scope of the invention as defined in the appending claims.

PART LIST

1. capillary tubes
2. actuators
3. meniscus
4. receiving sheet
5. print head
6. header tank
7. ink chamber
8. ink feed outlet
9. vacuum inlet
10. supply inlet
11. re-flow inlet
12. channel
13. float
14. magnet
15. reed contact
16. damper
17. partitions
18. common sidewall
19. break-away seal
20. ink channel
21. mounting hole/slit

What is claimed is:

1. An ink tank for being mounted on a carriage for supplying ink to an inkjet print head mounted on the carriage, said ink tank comprising:

one or more ink chambers, each of said ink chambers including one or more functional elements symetrically arranged, mounted and centered about a predetermined center plane of said respective ink chamber, said center plane being positioned perpendicular to a direction of movement of said carriage, each said ink chamber further comprising a re-flow inlet above an ink level for accepting degassed air from the print head.

2. The ink tank according to claim 1 wherein the functional elements of each said ink chamber comprise a feed outlet for feeding ink to the print head.

3. The ink tank according to claim 1 wherein the functional elements of each said ink chamber comprise an ink level sensor having a float with integrated magnet coupled to a reed relay.

4. The ink tank according to claim 1 wherein the functional element of each said ink chamber comprise an ink movement damper located between a supply inlet for supplying ink to the ink chamber, and a feed outlet for providing ink to the print head.

5. The ink tank according to claim 4 wherein the damper comprises a labyrinth for restricting movement of the ink within the ink chamber.

6. The ink tank according to claim 4 wherein the damper comprises means for degassing supplied ink.

7. The ink tank according to claim 1 comprising a vacuum connection for connecting the ink tank to a vacuum source for extracting air from the tank.

8. The ink tank according to claim 1 wherein two of the ink chambers have a common side-wall and wherein the two ink chambers can be interconnected by breaking away a seal.

9. An inkjet printer comprising a replaceable ink tank for being mounted on a carriage for supplying ink to an inkjet print head mounted on the carriage, said ink tank comprising: one or more ink chambers, each of said ink chambers including one or more functional elements symmetrically arranged, mounted and centered about a center plane of said respective ink chamber, said center plane being positioned perpendicular to a direction of movement of said carriage each said ink chamber further comprising a re-flow inlet above an ink level for accepting degassed air from the print head.

10. An ink tank for supplying ink to an inkjet print head, both the ink tank and the print head being mounted onto a movable carriage, said ink tank comprising:

one or more ink chambers, each of said ink chambers including one or more functional elements symmetrically arranged, mounted and centered about a center plane of said respective ink chamber, said center plane being positioned perpendicular to a direction of movement of said carriage, said functional elements comprising a feed outlet for feeding ink to the print head, a supply inlet for supplying ink to the ink chamber, an ink movement damper, an ink level sensor, a vacuum inlet to extract air from the ink chamber, and a re-flow inlet to allow re-flow of air bubbles from the print head to the ink chamber.

* * * * *